US005799843A

United States Patent [19]

Hsu

[11] Patent Number: 5,799,843

[45] Date of Patent: Sep. 1, 1998

[54] BELT HANGER WITH BUCKLE PROTECTING JACKET

[76] Inventor: Chao-chun Hsu, 7-3, Lane 140, Chan Swei Road, Chan Hua City, Taiwan

[21] Appl. No.: 966,323

[22] Filed: Nov. 7, 1997

[30] Foreign Application Priority Data

Jan. 30, 1997 [TW] Taiwan ..... 86201602

[51] Int. Cl.[6] ..... A47G 25/14; A47G 25/54; B65D 33/14

[52] U.S. Cl. ..... 223/85; 383/23

[58] Field of Search ..... 223/87, 85; 383/22, 383/23, 24, 79, 92

[56] References Cited

U.S. PATENT DOCUMENTS 3,495,763 2/1970 Schmidt et al. ..... 383/23

3,934,631 1/1976 Wilson et al. ..... 383/23

4,282,911 8/1981 Sumitomo ..... 383/23

4,983,047 1/1991 Netto ..... 383/79

5,615,810 4/1997 Kolton et al. ..... 223/87

*Primary Examiner*—Bibhu Mohanty

*Attorney, Agent, or Firm*—Harrison & Egbert

[57] ABSTRACT

A belt hanger is composed of a hanging piece, a hook secured to the hanging piece, a retaining piece secured to the hanging piece, a buckle holder fastened with said retaining piece for holding the buckle of a belt. The retaining piece is provided with a protective jacket fastened therewith for protecting the buckle of the belt.

6 Claims, 5 Drawing Sheets

BELT HANGER WITH BUCKLE PROTECTING JACKET

FIELD OF THE INVENTION

The present invention relates generally to a belt hanger, and more particularly to a belt hanger having a protective jacket for protecting the buckle of a belt which is held by the belt hanger.

BACKGROUND OF THE INVENTION

The belt is one of the most popular consumer goods available in the market place today. The belts are generally displayed in quantity in stores such that they are organized in groups, and that they are displayed in good order by the belt hangers. The conventional belt hangers are generally primitive and defective in design in that they are not provided with means for protecting the buckles of the belts from oxidation, dust, mechanical friction, etc.

SUMMARY OF THE INVENTION

The primary objective of the present invention is therefore to provide a belt hanger with a protective jacket for protecting the buckle of a belt.

In keeping with the principle of the present invention, the foregoing objective of the present invention is attained by a belt hanger having a hook, a hanging piece, a retaining piece, a buckle holder, and a protective jacket for protecting the buckle of a belt. The hook and the retaining piece are secured to the hanging piece. The buckle holder is retained by the retaining piece. The buckle of a belt is retained by the buckle holder such that the buckle is enclosed by the protective jacket of a transparent material.

The foregoing objective, features and functions of the present invention will be more readily understood upon a thoughtful deliberation of the following detailed description of the present invention with reference to the accompanying drawings.

DETAILED DESCRIPTION OF THE INVENTION

Figure 1:
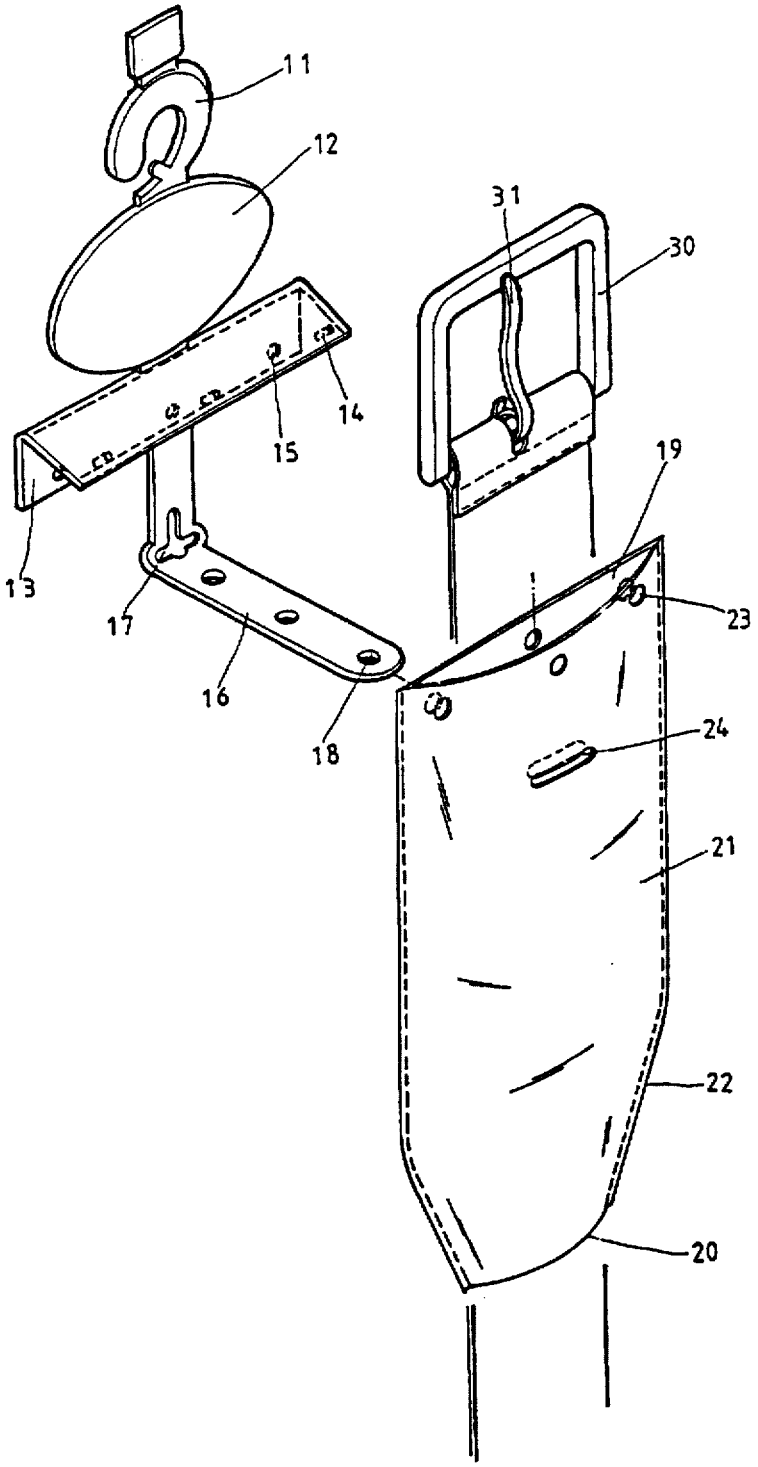
FIG. 1 shows a partial exploded view of an embodiment of the present invention.
Figure 2:
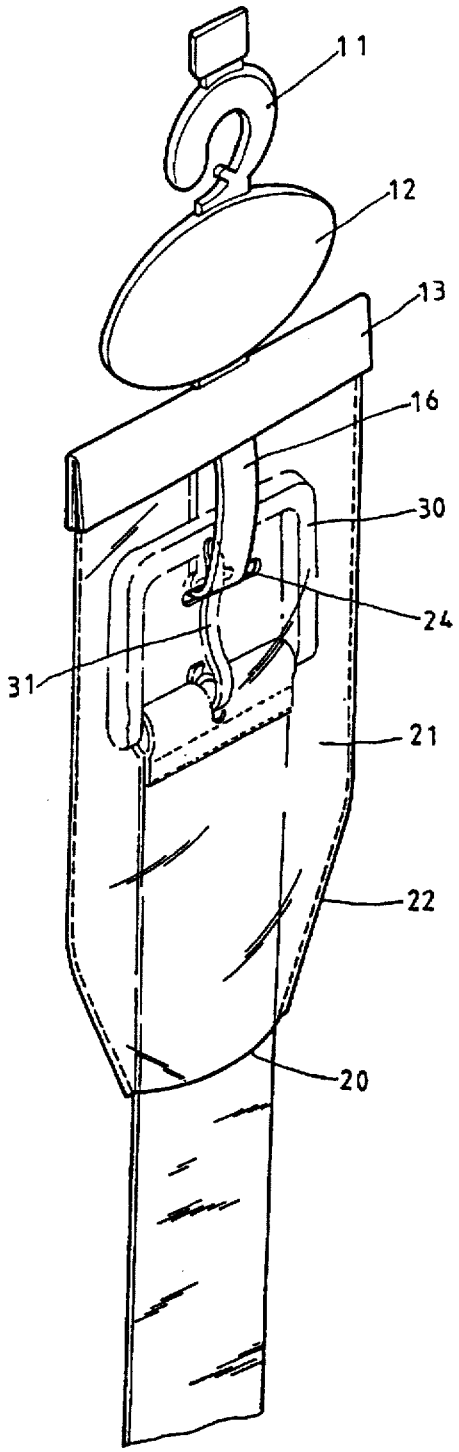
FIG. 2 shows a perspective view of the present invention in combination.
Figure 3:
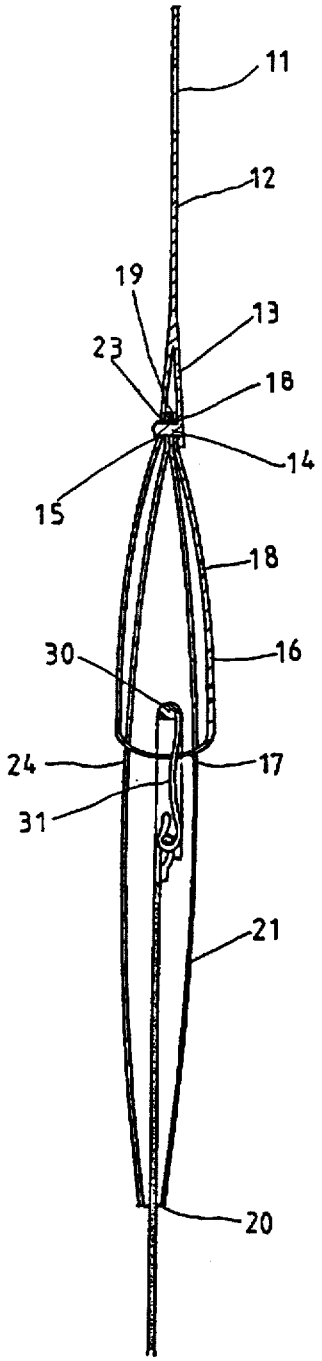
FIG. 3 shows a sectional view of the present invention in combination.

As shown in FIGS. 1–3, a belt hanger embodied in the present invention is composed of a hook 1 1, a hanging piece 12, a retaining piece 13, a buckle holder 16, and a protective jacket 21 for protecting a belt buckle 30 from oxidation, dust, mechanical friction, etc.

The hook 1 1 is secured to one side of the hanging piece 12, whereas the retaining piece 13 is fastened with another side of the hanging piece 12. Both buckle holder 16 and the protective jacket 21 are retained by the retaining piece 13, which is provided with a plurality of projections 14 and retaining holes 15 opposite in relation to and engageable with the projections 14. The buckle holder 16 is provided with a slot 17 and a plurality of perforations 18. The protective jacket 21 is provided at the lower end thereof with an opening 20, and at the upper end thereof with a plurality of retaining holes 23 corresponding in location to the projections 14 and the retaining holes 15 of the retaining piece 13. The protective jacket 21 is further provided with a through hole 24 corresponding in location to the buckle holder 16.

In combination, the buckle 30 of a belt is put into the protective jacket 21 through the opening 20 such that the pin 31 of the buckle 30 is located in the slot 17 of the buckle holder 16. The buckle holder 16 is then folded such that the buckle 30 of the belt is held by the buckle holder 16, and that one of the perforations 18 of the buckle holder 16 is engaged with the projection 14 of the retaining piece 13. The projection 14 is also engaged with the retaining hole 15. In the meantime, the upper end of the protective jacket 21 is retained by the retaining piece 13 such that the retaining holes 23 of the protective jacket 21 are engaged with the projections 14 of the retaining piece 13. The protective jacket 21 is made of a transparent material. The protective jacket 21 is further retained securely by the buckle holder 16, which is put through the through hole 24 of the protective jacket 21, as shown in FIG. 2.

Figure 4:
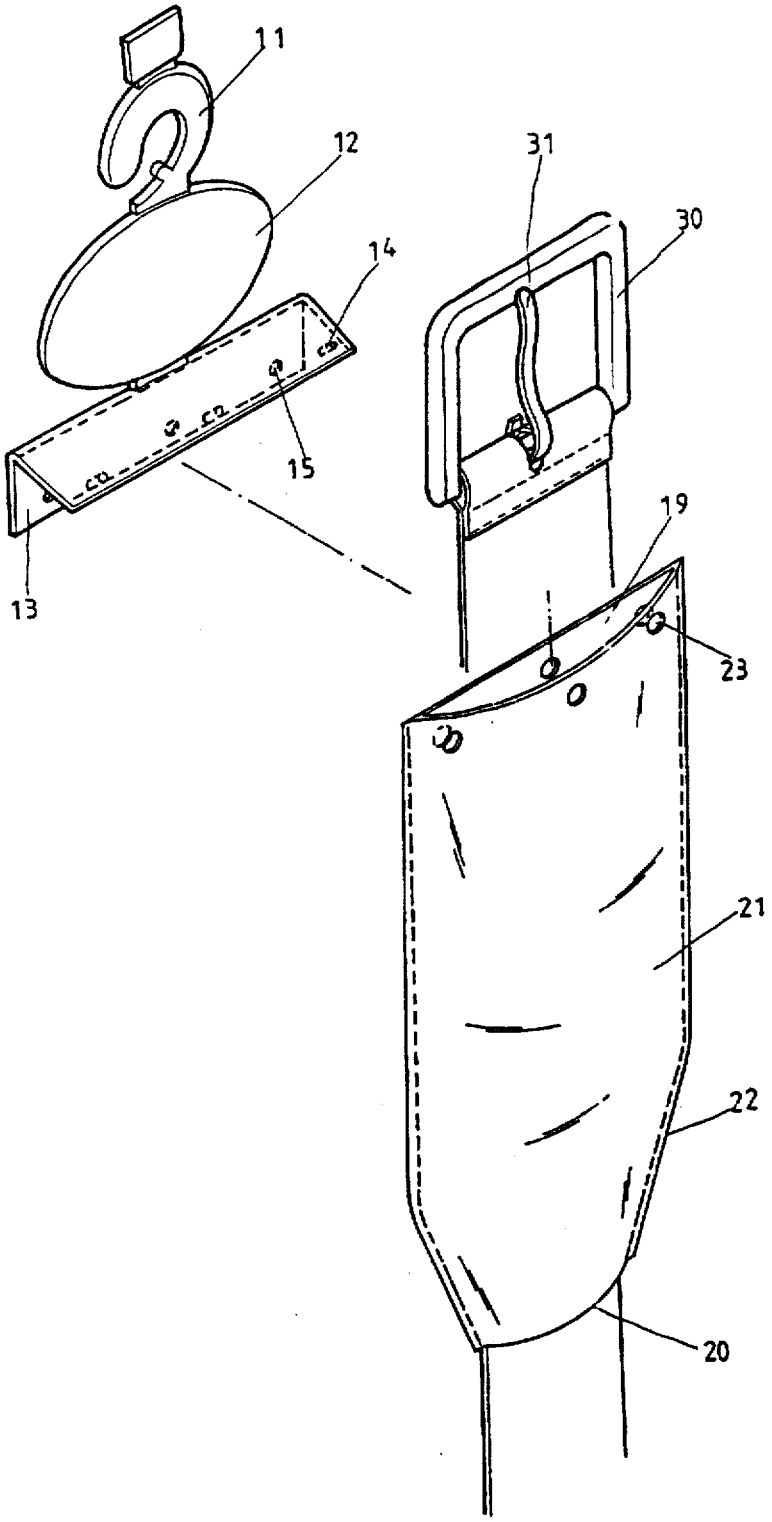
FIG. 4 shows a partial exploded view of a second embodiment of the present invention.
Figure 5:
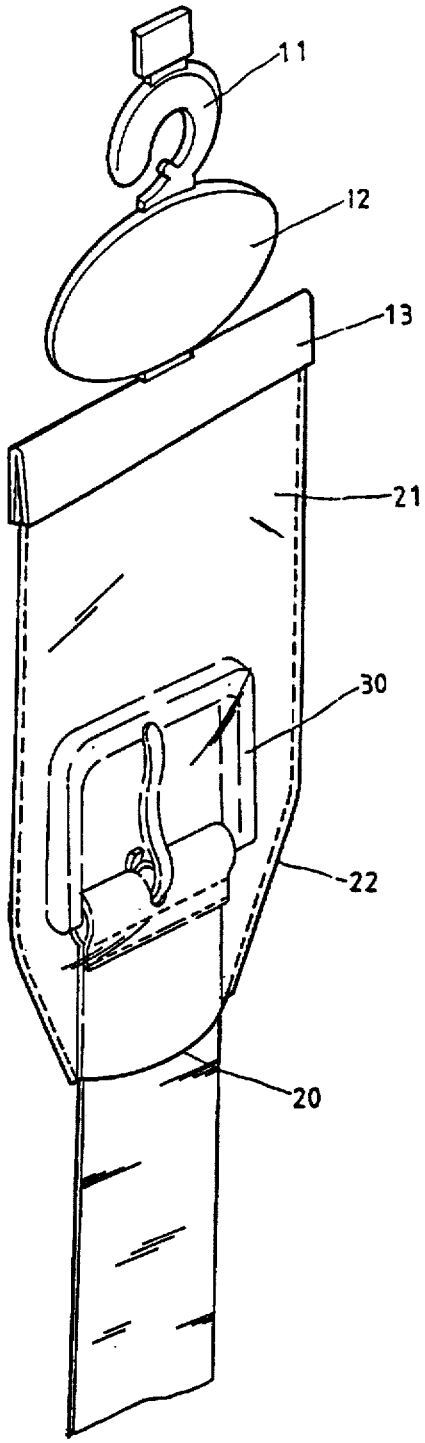
FIG. 5 shows a perspective view of the second embodiment of the present invention in combination.

As illustrated in FIGS. 4 and 5, a belt holder of another embodiment of the present invention is devoid of the buckle holder 16 of the first embodiment of the present invention. However, the protective jacket 21 of the second embodiment of the present invention is provided at the lower end thereof with a locating portion 22 contiguous to the opening 20 for locating the buckle 30 of a belt inside the protective jacket 21.

The embodiments of the present invention described above are to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. A belt hanger comprising:

a hanging piece;

a hook fastened with one side of said hanging piece;

a retaining piece fastened with another side of said hanging piece such that said retaining piece is opposite in location to said hook, said retaining piece provided with a plurality of projections and retaining holes corresponding in location to and engageable with said projections; and a buckle holder fastened at one end thereof with said retaining piece and provided with a slot for locating a pin of the buckle, said buckle holder further provided with a plurality of retaining holes engageable with said projections of said retaining piece;

wherein said retaining piece is provided with a protective jacket fastened therewith for shielding the buckle of a belt, said protective jacket provided at one end thereof with an opening and at another end thereof with a plurality of retaining holes engaged with said projections of said retaining piece.

2. The belt hanger as defined in claim 1, wherein said protective jacket is transparent.

3. The belt hanger as defined in claim 1, wherein said protective jacket is provided with a through hole for receiving therethrough said buckle holder.

4. A belt hanger comprising:

a hanging piece;

a hook fastened with one side of said hanging piece; and a retaining piece fastened with another side of said hanging piece such that said retaining piece is opposite in location to said hook, said retaining piece provided with a plurality of projections and retaining holes corresponding in location to and engageable with said projections;

wherein said retaining piece is provided with a protective jacket fastened therewith for shielding the buckle of a belt, said protective jacket provided with an opening and a locating portion contiguous to said opening for locating the buckle of the belt inside said protective jacket.

5. The belt hanger as defined in claim 4, wherein said protective jacket is transparent.

6. The belt hanger as defined in claim 4, wherein said protective jacket is provided at one end thereof with a plurality of retaining holes opposite in location to said opening of said protective jacket and engageable with said projections of said retaining piece.

* * * * *